US007146879B2

(12) United States Patent
Crudgington, Jr.

(10) Patent No.: US 7,146,879 B2
(45) Date of Patent: Dec. 12, 2006

(54) CHAMPAGNE BOTTLE OPENER

(76) Inventor: Cleveland Benedict Crudgington, Jr., 222 N. Myrtle Ave., Monrovia, CA (US) 41016

( * ) Notice: Subject to any disclaimer, the term of this patent is extended or adjusted under 35 U.S.C. 154(b) by 190 days.

(21) Appl. No.: 10/746,780

(22) Filed: Dec. 29, 2003

(65) Prior Publication Data

US 2005/0139040 A1 Jun. 30, 2005

(51) Int. Cl.
*B67B 7/02* (2006.01)

(52) U.S. Cl. ..... 81/3.55; 81/3.08; 81/3.36; 81/302

(58) Field of Classification Search ..... 81/3.55, 81/3.08, 3.36, 3.37, 3.29, 302, 3.44, 3.56, 81/415–417
See application file for complete search history.

(56) References Cited

U.S. PATENT DOCUMENTS 4,018,110 A * 4/1977 Spriggs ..... 81/3.08
4,387,609 A * 6/1983 Polsfuss ..... 81/3.36
4,598,613 A * 7/1986 Baum ..... 81/3.37
4,680,993 A * 7/1987 Feliz ..... 81/3.37
4,729,267 A * 3/1988 Giebeler ..... 81/3.37
4,875,394 A * 10/1989 Crudgington, Jr. ..... 81/3.08
5,868,044 A * 2/1999 Sonderman ..... 81/3.29
6,386,069 B1 * 5/2002 Olivera et al. ..... 81/3.29

* cited by examiner

*Primary Examiner*—Hadi Shakeri

(57) ABSTRACT

The Champagne Bottle Opener, a hand manipulable device is described for removing mushroom-shaped stoppers from sparkling beverage bottles. It includes a pair of bifurcated jaws and opposing handles about a common pivot wherein each jaw contains improvements over prior art, improvements that enable the device to function more effectively for the wide dimensional variances in bottle and cork diameters commonly found in the marketplace. The opposing handles contain improvements as well permitting the device to be operated more easily and safely. Also included in the present invention are features that generate a tactile "snap" when the device is properly inserted about the bottle, and provide improved means for anchoring the tool when engaging in the extraction of any mushroom-shaped stopper.

10 Claims, 6 Drawing Sheets

FIG. 2
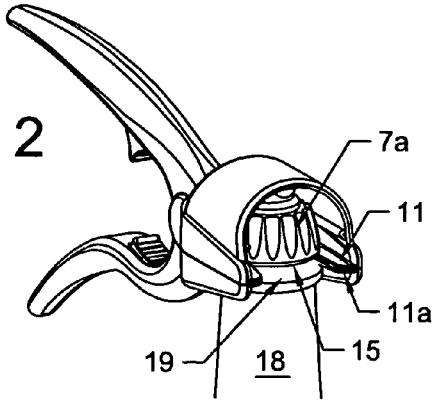
FIG. 2a
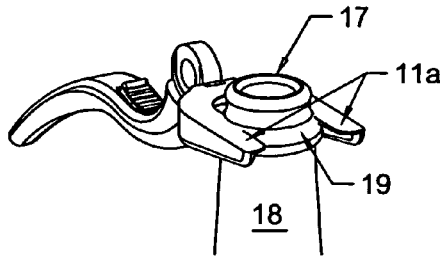
FIG. 3
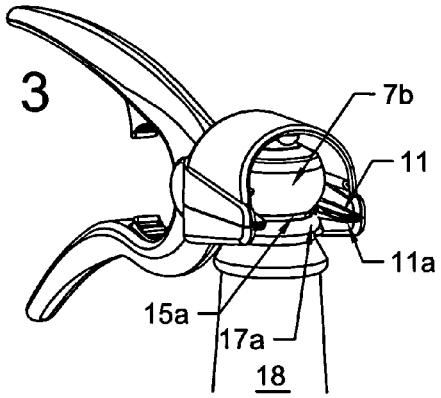
FIG. 3a
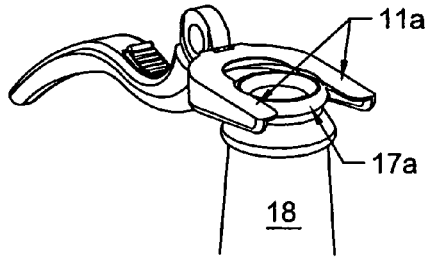
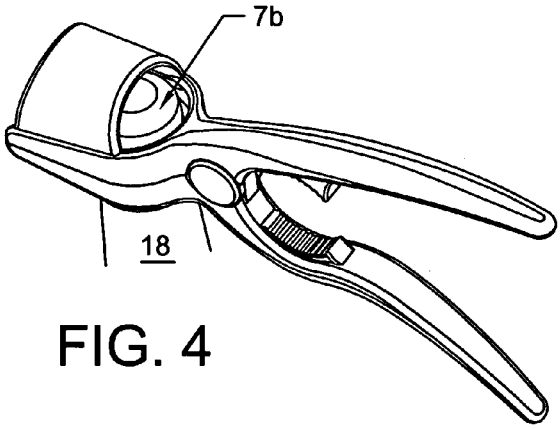
FIG. 4
FIG. 4a
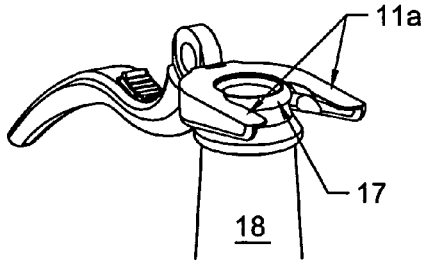

FIG. 5
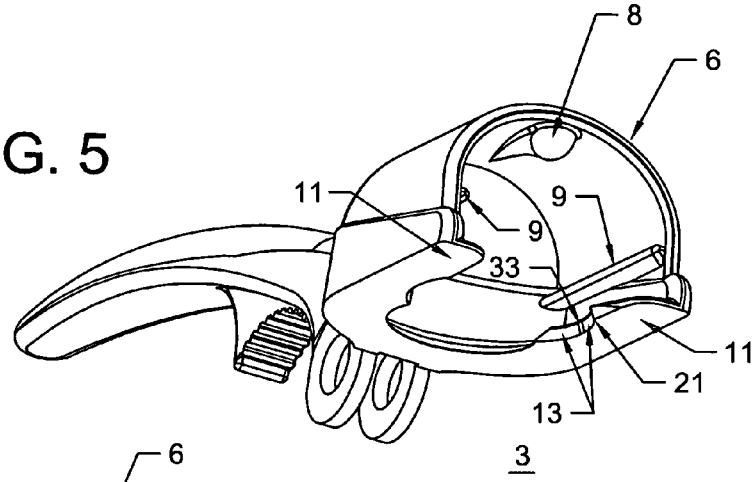
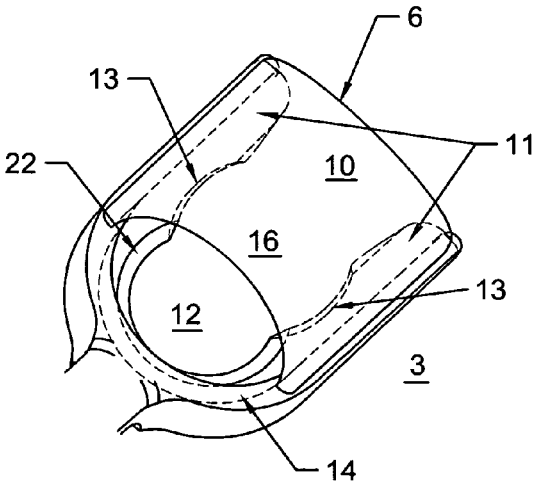
FIG. 6
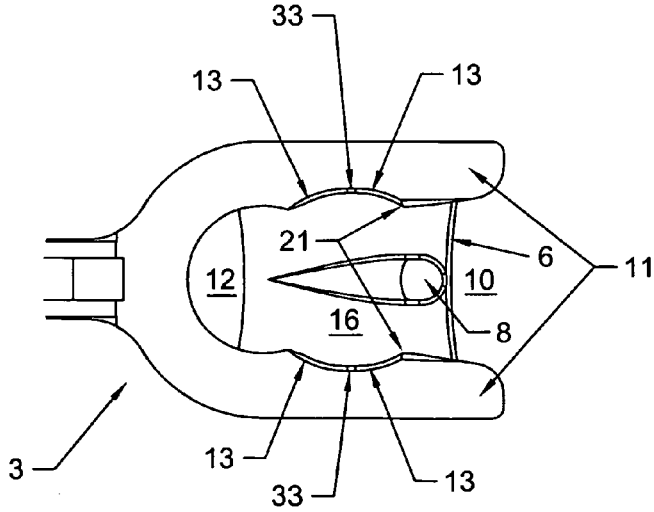
FIG. 7

CHAMPAGNE BOTTLE OPENER

BACKGROUND OF THE INVENTION

1. Field of the Invention

The present invention applies to specific improvements to bottle stopper removers for removing mushroom-shaped stoppers, those commonly made from either cork or plastic, from champagne and other sparkling beverage bottles, and more specifically applies to extractors that incorporate opposing bifurcated jaws and a pair of handles about a common pivot; jaws that provide a leveraged lifting action for removing the stopper by squeezing said handles.

2. Description of Related Art

Invention and use of bottle stopper removers for sparkling beverages sealed with mushroom-shaped stoppers are known to the public. The concept of using bifurcated jaws for such devices was first introduced by Spriggs, U.S. Pat. No. 4,018,110. While the concepts disclosed by Spriggs are valid, significant refinements brought forth in Crudgington U.S. Pat. No. 4,875,394 were necessary to produce a viable product of this type.

This type of bottle stopper remover in its basic form is comprised of upper and lower bifurcated jaws that engage about the neck or top of the bottle. Each jaw forms a pair of prongs with essentially a U-shaped blade incorporated therein. Depending on its application the blade associated with the lower jaw rests directly on either the flared section directly below the bottle's lip or on the top of the bottle's lip, while the blade belonging to the upper jaw is positioned under the head of either a cork or plastic stopper. A squeeze of a pair of handles about a common pivot results in the spreading of the jaws which in turn serves to exert an upwardly-directed leveraged force on the stopper, thus eliminating the need to manually "wrestle" the stopper out of the bottle.

3. Object of the Invention

It is the object of the present invention to provide significant improvements to inventions previously disclosed by Spriggs and Crudgington that enhance the function of hand manipulable devices of this type for removing mushroom shaped stoppers from sparkling beverage bottles.

SUMMARY OF THE INVENTION

The present invention focuses particularly on certain improvements in such pullers hereafter referred as the champagne bottle opener, or simply the opener, puller or extractor. Prior art neglects to address problems arising from the wide dimensional variances found in sparkling beverage bottles and stoppers contained therein. Of greatest concern is the variation in diameter of the lip at the top of the bottle and the diameter of the stopper, particularly those made of natural cork The lip of sparkling wine bottles will vary in diameter from about 1.04" to 1.15" and the size of cork stoppers varies even more; in some cases the cork's head is only slightly larger than the bottle's lip. If the problems associated with these dimensional variances is not adequately addressed, the opener of the bifurcated jaw type may fail to function properly: if too large the upper jaw may inadvertently slip over a small cork stopper without lifting it; or if too small, the opener may break or worse yet, chip shards of glass from the bottle's lip while attempting to slide over the lip. For an opener to be reliable over the broadest range of bottle and cork configurations, the problems arising from dimensional variances are examined and improvements are set forth. The full implication of these size variations will be detailed along with advancements in the current invention that address the corresponding issues.

Introduced in my invention are significant refinements in the upper and lower bifurcated jaws that improve stopper retaining means, stopper gripping means and bottle anchoring means, along with identifying the importance of the material used to obtain desired mechanical characteristics. The upper and lower bifurcated jaw depicted in prior art have limitations not previously addressed. Recesses within their respective jaws teach opposing "U"-shaped blades having linear edges intended for making contact with bottle and stopper. Yet the jaws, as described in prior art, fail to provide a method to properly anchor the tool to the bottle. If the tool is not fully and properly inserted the ejected stopper can accidently flying into the air or the tool can flip out of the user's hands with a forcefully ejected stopper. Additionally, the present invention recognizes that a straight-edged blade is not the ideal configuration for gripping a cork.

In addition to providing the means for proper anchoring, the present invention addresses the benefit of providing means to inform the user that the tool has been fully and properly positioned for extracting a stopper. A tactile snap, generated by novel embodiments to the upper jaw, give the user helpful feedback that the tool has been properly positioned on the bottle. Furthermore, this invention teaches embodiments to the recess within the upper jaw that greatly improve the extractor's capability to grip a cork to be extracted by increasing the surface contact with the upper blade. And embodiments to the recess within the lower jaw further assist in the proper anchoring of the tool.

The present invention addresses Inherent problems(,) with spring clip mechanisms introduced in prior art for retaining or holding a stopper during extraction. Because of the wide range of stopper head sizes, gripping the stopper with spring mechanisms, proves to be an impractical method to retain the stopper. Either springs are too loose becoming ineffective at holding the stopper or they are too tight making insertion of the tool difficult. An improvement set forth eliminates the need for using spring clips or other means to grab or clamp the stopper.

The wish-bone shaped handle configuration depicted in prior art for bifurcated stopper extractors is replaced with an improved design that is fully set forth. The problems inherent in this configuration are addressed, with embodiments that enhance the manipulation of the opener without sacrificing leverage capability or vertical lift.

In order to achieve sufficient lift and leverage using the "wish-bone" handle configuration taught in prior art, the handles require a separation that proves uncomfortably wide for those users with smaller hands. Additionally, the pair of handles tend to cross one another at their ends when fully squeezed if made from a material having even a slight degree of flexibility as with most plastics.

While not adversely effecting the extraction capability of the device, crossing handles tends to be annoying at the very least and at worst can result in the tool flying out of the user's hands when the cork is popped. By modifying the lower handle into an "S" shape both of the aforementioned problems are eliminated: without sacrificing lift achieved by the spreading jaws, the overall handle separation where gasped is reduced; and the possibility of the handles crossing is eliminated by becoming generally parallel when fully squeezed.

BRIEF DESCRIPTION OF THE DRAWINGS

FIGS. 2 & 2*a* are perspective views of the opener assembly and the lower lever positioned for extraction of all mushroom-shaped plastic stoppers from a typical sparkling beverage bottle.

FIGS. 3 & 3*a* are perspective views of the opener assembly and the lower lever positioned for removal of a cork stopper sealing an unusually large-lipped sparkling beverage bottle.

FIGS. 4 & 4*a* are perspective views of the opener assembly and the lower lever positioned for removal of cork stoppers sealing all normal sized sparkling beverage bottles.

FIG. 5 is a perspective view of the upper lever showing preferred embodiments of the upper jaw and associated elements.

FIG. 6 is a top perspective view of the upper jaw detailing preferred embodiments of the blade configuration.

FIG. 7 is a bottom orthographic view of the upper jaw detailing preferred embodiments of the blade configuration and the stopper retaining means.

DESCRIPTION OF PREFERRED EMBODIMENTS

The basic elements comprising a bifurcated stopper puller are not new to the art as they were introduced and described in prior art. The present invention introduces numerous and significant improvements to all such pullers. Whereas the preferred configuration of the improvements relating to the invention has been illustrated and described herein, it should be realized that the embodiments are to be considered in all respects illustrative and not restrictive.

Figures 1, 1A, 1B, 1C:
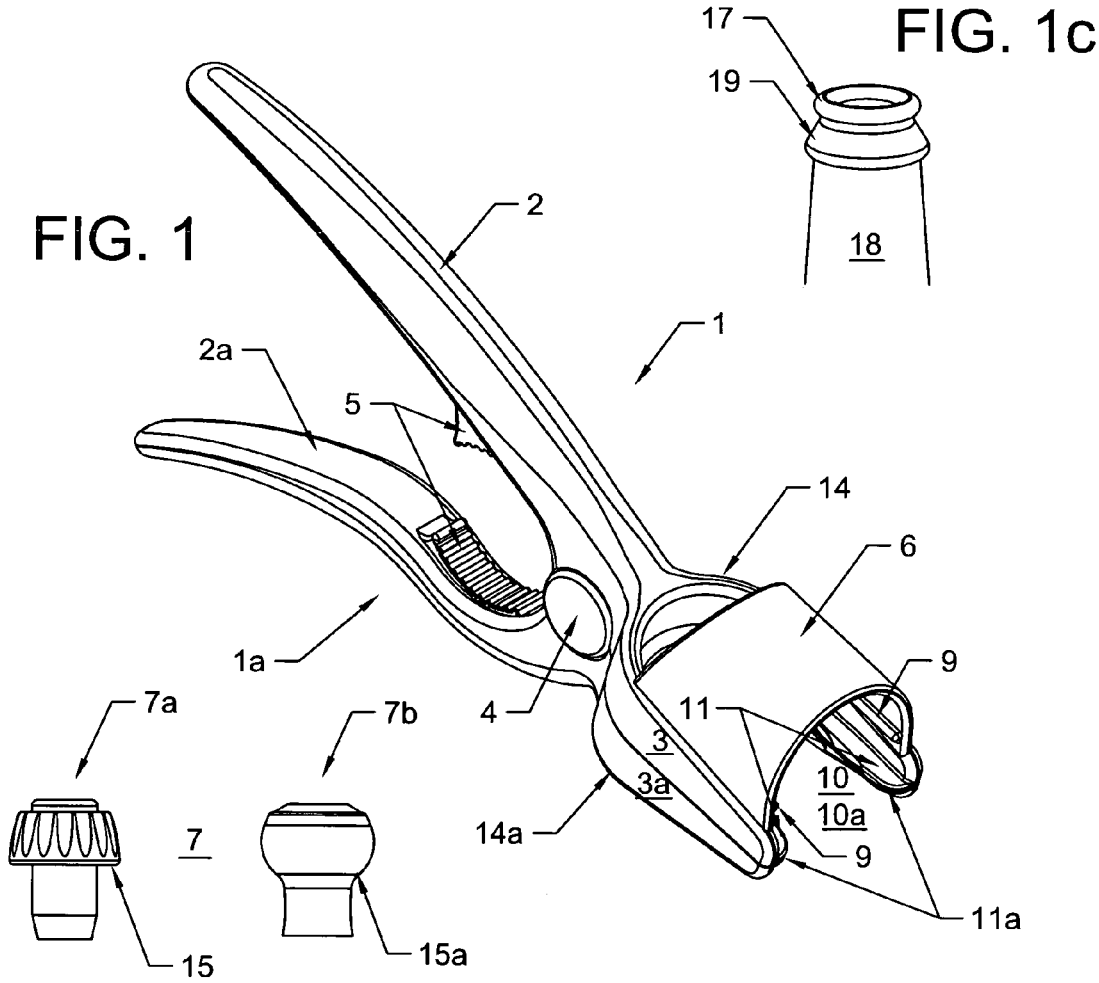
FIG. 1 is a perspective view of the assembled Champagne Opener consisting of an upper lever, lower lever, a pair of hinge pins that snap together and an internal hinge spring not shown.
FIGS. 1*a* & 1*b* illustrate the two classes of mushroom-shaped stoppers used in sealing sparking beverage bottles: those made of plastic and those made of cork.
FIG. 1*c* illustrates the upper portion of a typical sparkling beverage bottle intended for sealing with a mushroom-shaped stopper.

The bifurcated stopper puller illustrated in FIG. 1 is comprised of a pair of levers, upper 1 and lower 1*a*, which at one end form a pair of handles, upper 2 and lower 2*a*, and at the opposite end a pair of bifurcated jaws, upper 3 and lower 3*a*. The levers 1 and 1*a* are joined by a pivot pin assembly 4, so that the squeezing together of the handles 2 and 2*a* causes the opening of upper 3 and lower 3*a* jaws. Typically, a spring (not shown) is placed between the handles 2 and 2*a* for returning the levers 1 and 1*a* to their original rest position, making the puller easier to hold during placement. Additionally, stopper gripping means 5 is positioned between the handles 2 and 2*a* for conventional cork removal by gripping and rotating the stopper. A stopper retaining member 6 is affixed to the upperjaw 3. Bifurcated jaws, upper 3 and lower 3*a* each have a pair of ridges 14 and 14*a* formed around their perimeters for reinforcement. The interior of upper 3 and lower 3*a* jaws contain upper blade 11 and lower blade 11*a* respectively, each of which forms a generally "U" shaped upper recess 10 and lower recess 10*a*.

Upper recess 10 provides the means for addressing either a mushroom-shaped plastic stopper 7*a* below its base 15 as shown in FIG. 1*a*, or mushroom-shaped cork stopper 7*b* at it's downwardly presented shoulder 15*a* as shown in FIG. 1*b*; and the lower recess 10*a* provides the means for anchoring to either the lip 17 or shoulder 19 of a sparkling wine or similar beverage bottle 18 as shown in FIG. 1*c*, that is typically sealed with either plastic stopper 7*a* or cork stopper 7*b*. Henceforth, any reference that refers to both plastic stopper 7*a* and cork stopper 7*b*, will be referred to simply as stopper 7. To accommodate the wide variety of bottle-stopper configurations three positions for placing the opener around the bottle 18 are available as illustrated in FIGS. 2, 3 & 4, wherein each position addresses different stopper 7 and bottle 18 configurations. As shown in FIGS. 2 & 2*a*, the opener rests on shoulder 19 of bottle 18, that being the proper anchoring position for removing all plastic stoppers 7*a*. As seen in FIGS. 3 & 3*a*, the opener rests on top of the bottle's lip 17*a* having unusually large internal and external diameters as is the case with certain European brands. FIGS. 4 & 4*a* illustrate the third manner of inserting the opener for most cork stopper 7*b* and bottle 18 configurations, where the opener is sized to rest on top of the typical bottle's lip 17 and to slip around the base of a typical cork stopper's head 15*a*.

Figure 8:
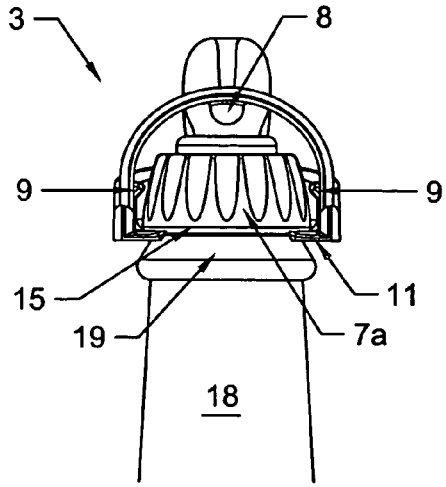
FIG. 8 is a front orthographic view of the upper jaw positioned for extraction of all plastic stoppers.
Figure 8A:
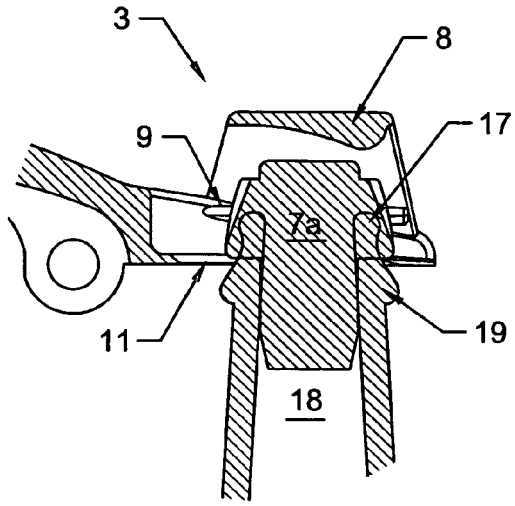
FIG. 8*a* is a side orthographic section view of FIG. 8 primarily illustrating the relationship between plastic stopper and stopper retaining means.
Figure 9:
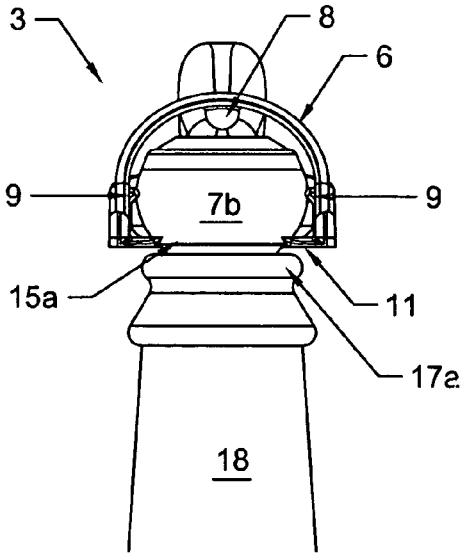
FIG. 9 is a front orthographic view of the upper jaw positioned for extraction of a cork stopper sealing an unusually large-lipped sparkling beverage bottle.
Figure 9A:
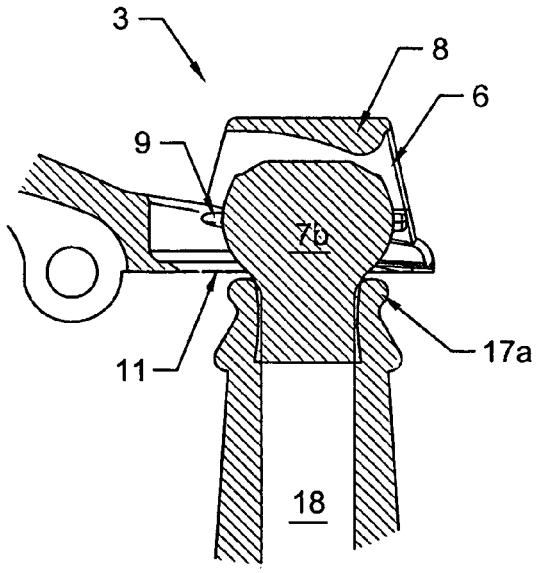
FIG. 9*a* is a side orthographic section view of FIG. 9 primarily illustrating the relationship between cork stopper and stopper retaining means.

FIGS. 5, 6, 7, 8, 8*a*, 9 & 9*a* show the upper jaw 3 configuration in various views, with FIGS. 8 & 8*a* illustrating the application with a typical plastic stopper 7*a* and sparkling beverage bottle 18; and FIGS. 9 & 9*a* showing one of two possible positions to engage a cork stopper 7*b*, in this case one sealing a sparkling beverage bottle 18 with an unusually large lip 17*a*. In order to prevent any stopper 7 from inadvertently ricocheting out from under the stopper retaining member 6, prior art introduced the use of a spring loaded stopper retaining member or a stopper retaining member with one or more spring loaded clips. Experience has shown that the use of a spring loaded mechanism to grip the stopper 7 has several inherent problems: springs tend to weaken over time, making them less reliable; the force that springs apply for gripping purposes tends to work against the insertion of the opener; and the wide size range of cork stoppers 7*b* results in the spring clip mechanism becoming ineffective for unusually large or small stoppers 7*b*. Spring clip(s) are found to be either too loose for small-headed corks or too tight for large-headed corks. Even in those cases where properly sized, spring clip(s) tend to impede the insertion of the opener around the stopper because the clip(s) exert a counter force while engaging about the stopper's head. The result is an increased difficulty in positioning the tool for insertion about the stopper 7, or increased difficulty in inserting the opener into the proper position for extraction. In the present invention, the stopper retaining member 6, either attached to or made part of the upper jaw 3, includes a refinement that eliminates the need to grip the stopper 7 in order to prevent its accidental ejection from the opener. Rather than proving means to grip the stopper 7, a stopper deflecting means 8 is centered within the stopper retaining member 6, and is positioned and beveled in such a manner as to deflect the released stopper 7 towards the rear of the upper jaw 3 where it is safely contained within the retaining member 6. This deflecting means 8 can best be understood in FIGS. 8*a* & 9*a*. Since the deflecting means 8 is not required to make contact with the pre-extracted stopper 7 in order to be effective, the stopper retaining member 6 along with deflecting means 8 can be sized to accommodate even the larger cork stoppers 7*b* without sacrificing its effectiveness with smaller stoppers 7.

Another significant improvement set forth is the addition of a pair of rails 9 on both sides and within the interior of stopper retaining member 6, most clearly visible in FIG. 5. As can be visualized from viewing FIGS. 8 & 9, the pair of rails 9 helps guide the insertion of the opener around any stopper 7. FIGS. 8*a* & 9*a* show how the rails 9 are positioned above and primarily parallel to upper blade 11. The pair of rails 9 can be effectively spaced apart so that they make contact with most plastic stoppers since the dimensional variance of plastic stoppers 7*a* is nominal. Furthermore, a common element of all plastic stoppers 7*a* is that the widest portion is at the base of the head 15, thereby permitting the base of the head 15 to rest underneath rails 9 as illustrated in FIG. 8. Thus, pair of rails 9 provides the means to impede the upward motion of a released plastic stopper 7*a* and assist in discarding it from the opener by preventing the dislodged plastic stopper 7*a* from lifting up and catching on the beveled protrusion 8 as it is being pushed out of the opener.

As evident in FIGS. 5, 6 & 7, the stopper gripping means of blade 11 within upper jaw 3 has been enhanced by introducing a pair of opposing curvatures 13 within the generally "U" shaped recess 10 described in prior art. When these curvatures 13 are viewed together as illustrated in FIG. 6, the pair of curvatures 13 form a primarily circular slot 16, thereby increasing the possible surface contact between blade 11 and any stopper 7 when the opener is positioned as shown in FIG. 2 or 3. In both positions, the pair of curvatures 13 are aligned with and conform to the circular shape of all type stoppers 7 so that with plastic stoppers 7*a* as shown in FIG. 2, increased surface contact is made between blade 11 and the base of the plastic stopper head 15; or with cork stoppers 7*b* as shown in FIG. 3, increased surface contact is made between blade 11 and the downwardly presenting portion of a cork stopper's head 15*a*. Also included within the upper jaw 3 as seen in FIG. 6 is a secondary generally circular recess 12 positioned at the base of primary recess 10 for positioning the opener as seen in FIG. 4. And while recess 12 was disclosed in prior art, it is made significantly more effective by introducing an upwardly facing chamfer 22 seen most clearly in FIG. 6 so that recess 12 is wider at the top of blade 11 than at the bottom and having a cross-sectional width sufficient to permit the opener to pass under and around the base of a cork stopper 7*b*. By introducing chamfer 22 to recess 12, engagement between blade 11 and downwardly facing shoulder 15*a* is improved thereby eliminating the requirement to engage about a partially lifted the stopper 7*b* as defined in prior art. Recess 12 is further enhanced by increasing its curvature past 180° as shown in FIG. 7 so that blade 11 slightly encircles the cork stopper 7*b*, thus providing the means to generate a slight locking action when the opener is positioned for extraction.

As viewed in FIG. 7 a further innovation within the upper jaw 3 is the slight tapering of blade 11 at the entrance of upper recess 10 where the width of the upper recess 10 narrows from the entrance with the narrowest point 21 being at the front of opposing curvatures 13. By making the upper jaw 3 and/or blade 11 from a rigid material with some degree of flexibility, as with certain plastics, the narrowest point of blade separation 21 can be made to spread apart slightly during insertion. The primary recess 10 in upper blade 11 at its narrowest point 21 can thereby be appreciably less than the diameter of bottle 18 where applied, that being directly under the head of plastic cork 7*a* as seen in FIG. 2, or appreciably less than the diameter at the base 15*a* of cork stopper 7*b* as seen in FIG. 3. This embodiment enhances the gripping means of blade 11 by further encompassing either type stopper 7 thereby increasing contact through the extended arc length of curvatures 13. Furthermore, the momentary splaying action of blade 11 during insertion of the opener creates a spring-loaded force that assists the user in properly positioning the opener by centering either bottle 18 as shown in FIG. 8, or cork stopper 7*b* as shown in FIG. 9, within the circular slot 16 as blade 11 returns from its flexed to normal shape. In addition, the momentary splaying of blade 11 generates a slight snapping action that can be felt, thereby informing the user that the puller has been fully and properly inserted.

FIGS. 8 & 8*a* illustrate a typical sparkling beverage bottle 18 sealed with a plastic stopper 7*a*. When the opener is positioned for extraction, the circular slot 16 within upper blade 11 shown in FIGS. 6 & 7 is centered about the bottle 18. Normally, all plastic stoppers 7*a* cover the bottle's lip 17 as shown in FIGS. 2 & 2*a* necessitating that upper blade 11 pass over lip 17 during removal of a plastic stopper 7*a*. For most domestic sparkling beverage bottles, the diameter of circular slot 16 is sized to be larger than lip 17 thereby providing adequate clearance for upper blade 11 to pass over bottle lip 17 during extraction. As seen in FIGS. 5 & 7 to remove a plastic stopper 7*a* sealing a sparkling beverage bottle with the largest diameter lip 17, curvatures 13 have been modified to accommodate a larger diameter lip 17. On each side of blade 11 curvature 13 has been elongated by splitting each curve into two nearly identical curvatures 13 whose radii are bisected by a slight separation 33 thereby forming two pair of adjacent curvatures 13 as seen in FIG. 7. The separation 33 between curvatures 13 enables upper blade 11 to slide over a bottle lip 17 having a diameter greater than that of curvatures 13, without necessitating the increase of the cross-sectional width of circular slot 16. By manufacturing the upper jaw 3 and/or upper blade 11 from a rigid material with some degree of flexibility, as with certain plastics, blade 11 can be made to spread apart sufficiently during the extraction of any plastic stopper 7*a*. By this means circular slot 16 remains sufficiently small for blade 11 to make the best possible contact with the underside 15 of a plastic stopper 7*a* or the downwardly presenting shoulder 15*a* of a cork stopper 7*b*.

Figure 10:
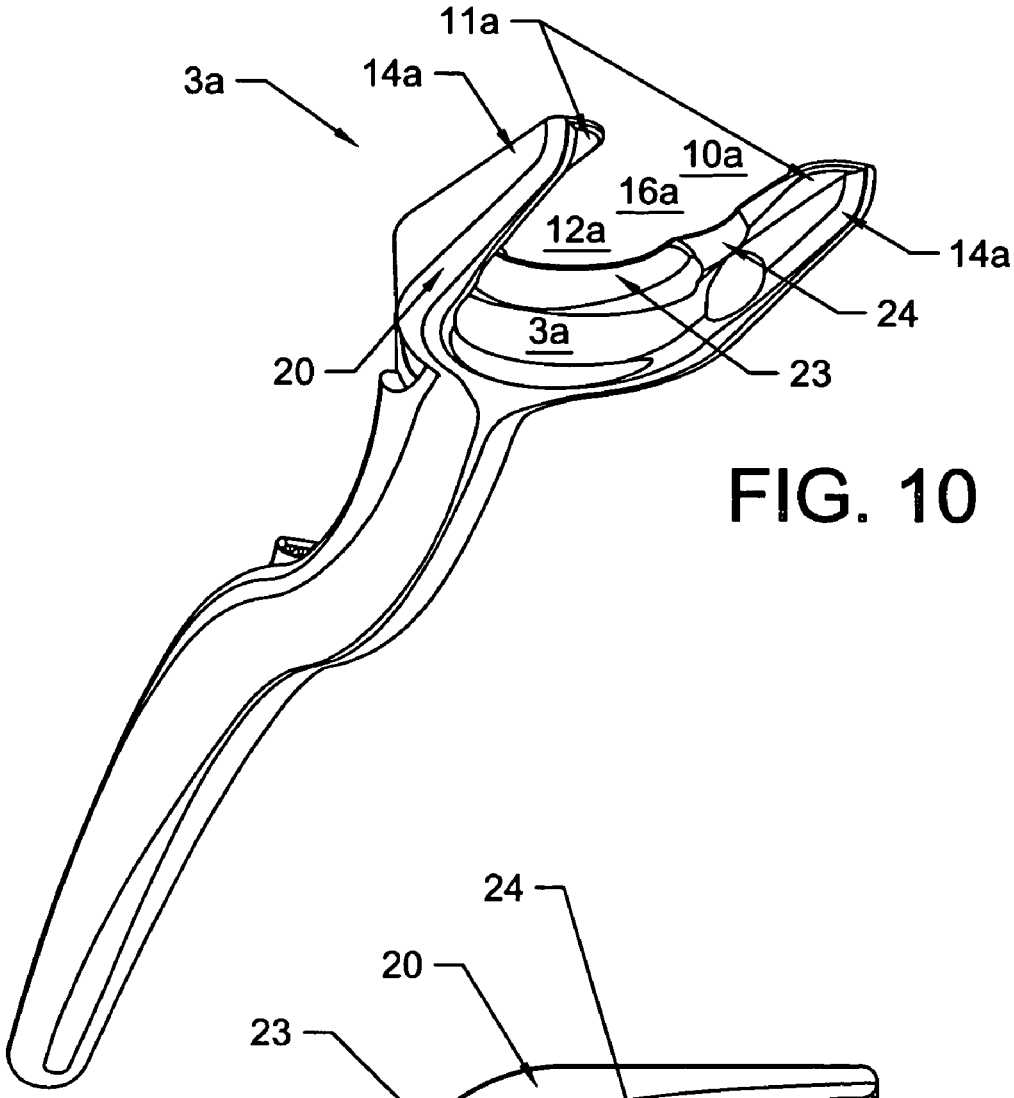
FIG. 10 is a perspective view of the lower lever showing preferred embodiments of the lower jaw and associated elements.
Figure 11:
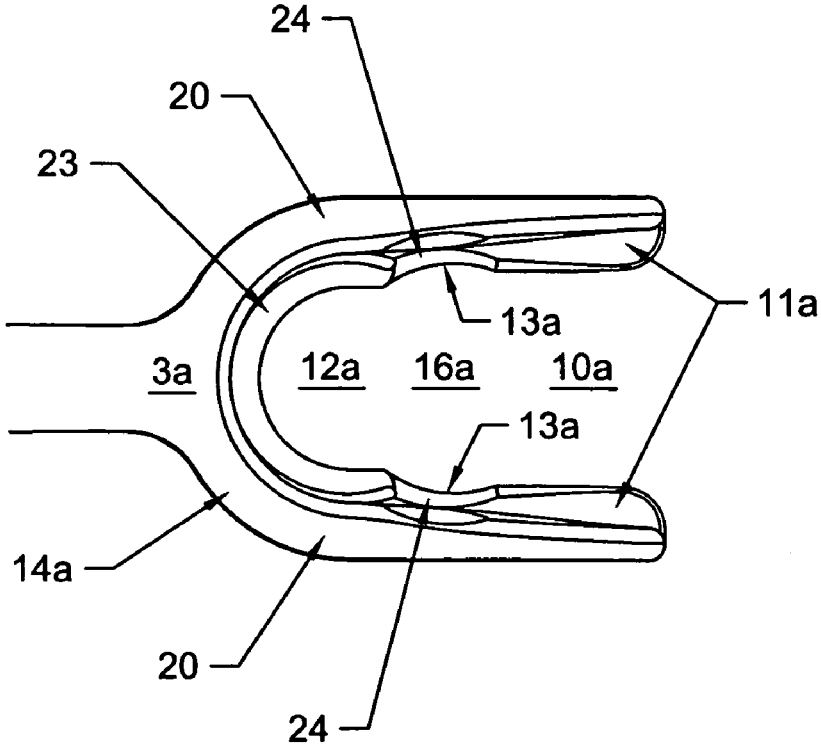
FIG. 11 is a bottom orthographic view of the lower jaw showing preferred embodiments of the lower jaw.
Figure 12:
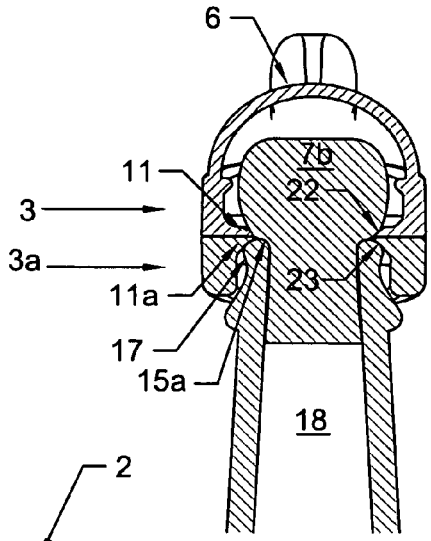
FIG. 12 is a front orthographic section view of FIG. 4 detailing embodiments of the upper and lower blade configuration when applied to a mushroom-shaped cork stopper sealed to a normal sized sparkling beverage bottle.

FIGS. 10 & 11 illustrate several improvements to the lower jaw 3*a*. The jaw's ridges 14*a* are significantly strengthened by incorporating a taper 20 from tip to base as viewed most clearly in FIG. 11. Tapered ridges 20 also assist in guiding the insertion of the opener around the bottle's shoulder 19 or bottle's lip 17. The anchoring means of blade 11*a* has been enhanced by introducing a pair of opposing curvatures 13*a* within the primary generally "U" shaped recess 10*a* brought forth in prior art. When the pair of curvatures 13*a* are viewed together as seen in FIG. 11, they form a primarily circular slot 16*a*, thereby encouraging the opener to become properly seated onto the bottle's shoulder 19 as illustrated in FIGS. 2 & 2*a*. Again referring to both FIGS. 10 & 11, by adding downwardly facing chamfers 24 to blade 11*a* at curvatures 13*a*, the positioning of the opener for removal of a plastic stopper 7*a* is enhanced. By contouring chamfers 24 to that of the typical bottle's shoulder 19, a tighter fit under plastic stopper 7*a* is made possible when the opener is positioned as shown in FIG. 2. Furthermore, anchoring of the lower jaw 3*a* has been improved when blade 11*a* is positioned about the bottle 18 as shown in FIGS. 3 & 3*a* because of the increased contact with bottle lip 17 made possible by the conforming shape of the pair of curvatures 13*a*. As seen in FIGS. 10 & 11 a secondary generally circular recess 12*a* is shown at the base of primary recess 10*a*, and while recess 12*a* was disclose in prior art, it has been made significantly more effective by introducing a downwardly facing chamfer 23 that generally conforms to the bottle's lip 18 when positioned as shown in FIGS. 4 & 4*a*. By adding chamfer 22 to secondary slot 12 in upper jaw 3 shown in FIG. 6, and by adding a reversed corresponding chamfer 23 to secondary slot 12*a* in the lower jaw 3*a* shown in FIGS. 10 & 11, the opener can be inserted between cork stopper 7*b* and bottle lip 17 without first having to partially dislodge the stopper from the bottle as required in the configuration claimed in prior art. The means to accomplish the placement of the opener shown in FIG. 4 as previously described can best be visualized by referring to FIG. 12 that illustrates the manner in which the upper and lower blades 11 & 11*a* form a tapered edge that is defined by opposing chamfers 22 and 23 within slots 12 and 12*a*.

Figure 13:
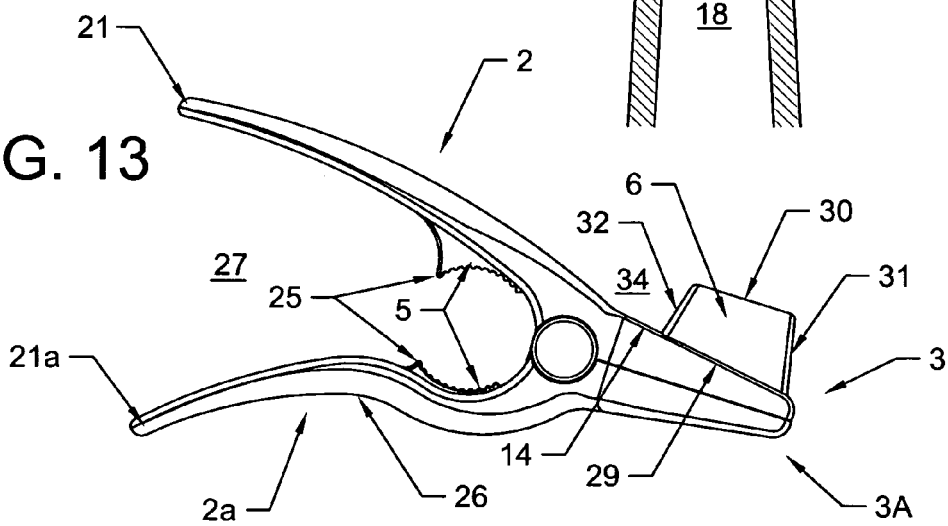
FIG. 13 is a side view of the opener assembly with the upper and lower levers in the "relaxed" position illustrating preferred embodiments to the handle configuration and the stopper retaining means.
Figure 14:
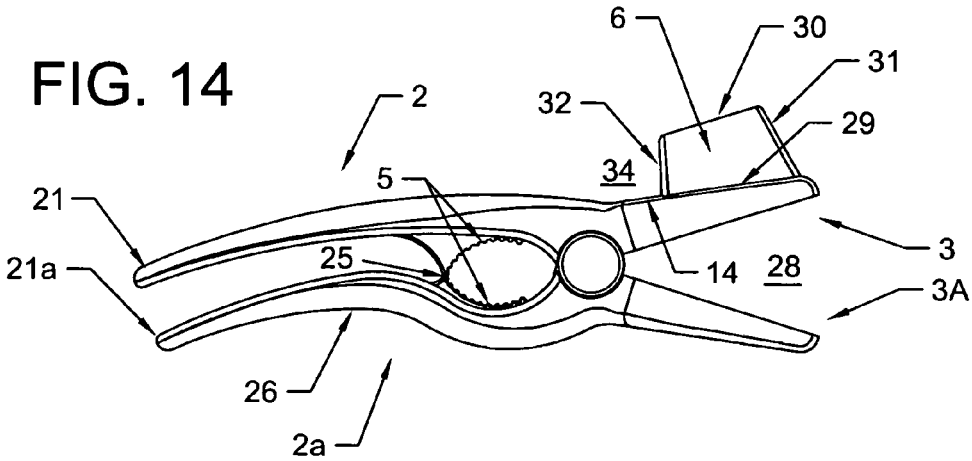
FIG. 14 is a side view of the opener assembly with the upper and lower levers in the fully squeezed position illustrating preferred embodiments to the handle configuration and the stopper retaining means.

FIGS. 13 and 14 illustrate several improvements in the pair of handles 2 and 2*a* over prior art. Experience reveals that with the wishbone handle configuration previously disclosed, the handles have an undesirable tendency to cross at their ends 21 & 21*a* when fully squeezed if made from a material having even a slight degree of flexibility as with most plastics. By reshaping the lower handle 2*a* so that its end 21*a* is primarily parallel to upper handle's end 21, the tendency for them to cross is greatly minimized. Furthermore, by including a stop means 25 between handles 2 & 2*a*, their ends 21 & 21*a* are prevented from making contact with one another when fully squeezed. This improvement not only prevents the squeezed handles 2 & 2*a* from crossing but eliminates the possibility of the user's palm from being pinched from handles that touch. By incorporating the stop means 25 as part of the stopper gripping means 5, the stop means 25 which would otherwise be an unattractive element becomes essentially hidden. Additionally, the lower handle 2*a* incorporates an upward curvature 26 thereby approximating a shallow "S" shape. This embodiment effectively reduces the maximum handle separation 27 in the relaxed position at the location where the opener is gripped, as seen in FIG. 13; at also improves the grasping of the handles for users with smaller hands without sacrificing the maximum possible angular separation 28 of jaws 3 and 3*a* available with the prior configuration, as seen in FIG. 14. Additional benefits are gained by reshaping the stopper retaining member 6. As can be seen in both orthographic FIGS. 13 & 14, the stopper retaining member 6 is in the form of a hood, and while the configuration was previously disclosed, the hood has been improved by the inclusion of front and rear tapers 31 & 32 making the hood 6 wider at its base 29 than at its apex 30. The front taper 31 increases the user's view of stopper 7 positioning the opener. The rear taper 32 expands the effective space 34 for the user's thumb to be inserted under the stopper retaining member 6 for pushing the extracted stopper 7 out of the opener. Additionally, the rear taper 32 provides reinforcement to the upper jaw 3 by permitting the extension of the base 29 further towards the rear of the upper ridge 14 than would otherwise be possible.

What is claimed is:

1. An extractor for extracting a generally mushroom shaped stopper from the neck of a typical sparkling beverage bottle, there being an upwardly presented shoulder on said neck and at the top of said neck includes a lip, there being a downwardly presented and openly accessible rim or shoulder on said stopper, and said extractor comprising a pair of levers which are pivotally interconnected, each lever defining a handle at one end thereof and a bifurcated jaw having a recess at the opposite end thereof, wherein one of said jaws is located above the other and each of said jaws is adapted to be horizontally inserted about said neck, such that the lower of said jaws is adapted to make contact with said upwardly presented shoulder of said bottle and the upper of said jaws is adapted to make contact with said downwardly presented rim or shoulder of said stopper, so that a squeezing together of said pair of handles results in the separation of said jaws thereby urging said lower jaw against said upwardly presented shoulder and urging said upper jaw against said downwardly presented rim or shoulder, and with leveraged force sufficient to lift said stopper relative to said neck, wherein:

the extremity of said bifurcated jaw of said upper lever comprise a pair of prongs defining said recess, with said bifurcated jaw formed entirely or partially from a material having sufficient flexibility to permit the momentary splaying of said prongs while being slid around said neck or over said lip of said bottle when the width of said recess, in its relaxed state, is less than the diameter of said neck or said lip at point of contact; and said recess within said upper jaw comprises both anterior and posterior sections such that the anterior section is defined by opposing generally non-parallel linear edges and the posterior section is defined by opposing generally identical semi-circular edges, wherein:

said anterior section guides the device about said bottle during insertion, and said posterior section positions said extractor about said bottle for extraction of said stopper; with the cross-sectional width of said recess at the juncture of said anterior and posterior sections being narrower than any other cross-sectional width within said anterior section of said recess; and said posterior section inscribing a generally circular shape approximating the outer diameter of said lip of said typical bottle; such that said momentary splaying of said prongs in conjunction with described contours of said anterior and posterior sections provide means for anchoring and positioning the device to said bottle, and generating a tactile snap during insertion thereby informing the user that the device has been anchored and positioned to said bottle.

2. The device as in claim 1, wherein said opposing semi-circular edges within said posterior section, are split and separated, thereby enabling said posterior section to slide over said lip of said typical bottle with said lip having a radius greater than any of said semi-circular edges.

3. The device as in claim 1, wherein said recess is deepened by a generally "U"-shaped slot inserted at the base of said posterior section thereby facilitating said momentary splaying of said prongs.

4. The device as in claim 1 wherein the opposing edges of said recess within said lower jaw, include a pair of opposing semi-circular downwardly presented beveled curvatures such that said beveled curvatures generally conform to the slope and diameter of said upwardly presented shoulder of said typical bottle when the device is properly positioned for extracting said stopper.

5. The device as in claim 1, wherein positioned between said handles adjacent to said pivotal connection, a pair of opposing generally semi-circular stopper grips, each comprising a row of generally parallel ridges, combine to provide gripping and twisting means to said stopper; posterior to said stopper grips, said handles become generally parallel to one another when said handles are fully squeezed; said handle of said lower lever forms a generally shallow "S" contour beginning at said pivotal interconnection, there being said stopper grip within the first curve of said "S" contour and said parallel portion defining the second curve of said "S" contour.

6. The device as in claim 5, wherein the posterior ridge of said parallel ridges of said stopper grip on said upper lever is aligned to contact the posterior ridge of said parallel ridges of said stopper grip on said lower lever; such that when said handles become fully squeezed said posterior ridges contact each other thereby preventing said handles from contacting at their extremities.

7. An extractor for extracting a generally mushroom shaped stopper from the neck of a sparkling beverage bottle, at the top of said neck there being a lip with an upwardly presented shoulder not concealed by said stopper, there being a downwardly presented and openly accessible shoulder on said stopper, and said extractor comprising a pair of levers which are pivotally interconnected, each lever defining a handle at one end thereof and a bifurcated jaw having a recess at the opposite end thereof, wherein one jaw is located above the other, and each of said jaws is adapted to partially encircle the narrowest exposed diameter of said stopper's downwardly facing shoulder, such that the lower jaw is adapted to make contact with said upwardly presented shoulder of said lip, and the upper jaw is adapted to make contact with said downwardly presented shoulder of said stopper, so that a squeezing together of said pair of handles results in the separation of said jaws, urging said lower jaw against said upwardly presented shoulder of said lip and urging said upper jaw against said downwardly presented shoulder, and with leveraged force sufficient to lift said stopper relative to said lip, the improvement comprising:

said recesses of said upper and lower jaws are defined primarily by aligned and opposing circular edges, wherein said opposing circular edges of said upper jaw have an upwardly facing bevel and said opposing circular edges of said lower jaw have a downwardly facing bevel, wherein said upper and lower beveled edges oppose one another thereby enabling said pair of upper and lower jaws to partially encircle the base of said downwardly presented shoulder of said stopper, with said lower jaw accessing said upwardly facing shoulder of said lip thereby providing means to engage said stopper without said stopper being partially dislodged from said bottle.

8. A device as in claim 7, wherein the arc of said circular edge defining said upper recess extends slightly past 180°, thereby providing means to generate a locking means when said upper jaw is applied to said stopper.

9. The device as in claim 7, wherein the extremity of said upper bifurcated jaw comprise a pair of prongs defining said recess, a generally inverted U-shaped stopper canopy is affixed to an uppermost portion of said prongs defining the recess for said upper jaw, a generally horizontal blade encompassing the interior of said prongs, a pair of opposing guide rails project inwardly having a generally horizontally fixed distance between the rails, and a generally vertically fixed distance between each of said guide rails and said blade; said horizontally fixed distance is less than the lowermost outer diameter of the head of said typical plastic stopper, and greater than the uppermost outer diameter of said head of said typical plastic stopper; said vertically fixed distance is sufficient so that horizontal motion of said typical plastic stopper is unrestrained by said guide rails, yet vertical motion of said typical plastic stopper is restrained by said guide rails.

10. An extractor for extracting a generally mushroom shaped stopper from the neck of a sparkling beverage bottle, there being an upwardly presented shoulder on said neck and a lip at the top of said neck, there being a downwardly presented and openly accessible rim or shoulder on said stopper, and said extractor comprising a pair of levers which are pivotally interconnected, each lever defining a handle at one end thereof and a bifurcated jaw having both a recess at the opposite end thereof, wherein one jaw is located above the other, such that said recess in said lower jaw is adapted to make contact with said upwardly presented shoulder or lip of said bottle, and said recess within the said upper jaw is adapted to make contact with said downwardly presented shoulder or rim of said stopper, so that squeezing together said pair of handles results in the separation of said jaws, urging said lower jaw against said upwardly presented shoulder or said lip of said bottle, and urging said upper jaw against said downwardly presented shoulder or rim of said stopper, and with leveraged force sufficient to lift said stopper relative to said bottle, wherein:

a generally inverted "U"-shaped stopper retaining canopy, integrally molded with or affixed to the bifurcated portion of said upper jaw, that includes a radially-centered downwardly extending beveled portion horizontally positioned and inwardly angled such that said stopper upon releasing from said bottle strikes said beveled portion of said canopy and deflects into the interior of said canopy.

* * * * *